US012398926B2

(12) United States Patent
Sishtla et al.

(10) Patent No.: US 12,398,926 B2
(45) Date of Patent: Aug. 26, 2025

(54) ECONOMIZER INJECTION IN A RECIPROCATING COMPRESSOR

(71) Applicant: Carrier Corporation, Palm Beach Gardens, FL (US)

(72) Inventors: Vishnu M. Sishtla, Syracuse, NY (US); Emir Alemic, Manlius, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 70 days.

(21) Appl. No.: 17/877,246

(22) Filed: Jul. 29, 2022

(65) Prior Publication Data

US 2023/0041180 A1 Feb. 9, 2023

Related U.S. Application Data

(60) Provisional application No. 63/229,250, filed on Aug. 4, 2021.

(51) Int. Cl.

| | |
|---|---|
| ***F25B 1/10*** | (2006.01) |
| ***F04B 25/04*** | (2006.01) |
| ***F04B 39/00*** | (2006.01) |
| ***F04B 39/12*** | (2006.01) |
| ***F04B 49/22*** | (2006.01) |

(52) U.S. Cl.

CPC ..... *F25B 1/10* (2013.01); *F04B 25/04* (2013.01); *F04B 39/0016* (2013.01); *F04B 39/122* (2013.01); *F04B 39/123* (2013.01); *F04B 49/22* (2013.01); *F04B 2205/07* (2013.01); *F25B 2400/13* (2013.01); *F25B 2600/2509* (2013.01)

(58) Field of Classification Search

CPC ..... F04B 25/04; F04B 39/08; F04B 39/10; F04B 39/123; F04B 49/22; F25B 2400/13; F25B 2600/2509

USPC ..... 417/250, 302, 308, 422, 442

See application file for complete search history.

(56) References Cited

U.S. PATENT DOCUMENTS 2,772,831 A 12/1956 Cotter
4,297,083 A * 10/1981 von Petery ..... F04B 49/24 417/505

(Continued)

FOREIGN PATENT DOCUMENTS

DE 10334947 A1 2/2005
EP 3236072 A1 10/2017

(Continued)

OTHER PUBLICATIONS

Extended European Search Report for European Application No. 22188169.1; Report Mail Date Dec. 2, 2022 (pp. 1-14).

(Continued)

*Primary Examiner* — Kenneth J Hansen

(74) *Attorney, Agent, or Firm* — CANTOR COLBURN LLP

(57) ABSTRACT

A compressor includes a cylinder block having a first bore and a cylinder head overlapping the cylinder block. The cylinder head has a second bore aligned with the first bore. The second bore is separated into a plurality of distinct regions including a suction region and an economizer region. A plurality of valves includes a suction valve selectively operable to fluidly couple the suction region and the first bore, and an economizer valve selectively operable to fluidly couple the economizer region and the first bore.

6 Claims, 4 Drawing Sheets

(56) References Cited

U.S. PATENT DOCUMENTS

| | | | | |
|---|---|---|---|---|
| 5,716,197 | A * | 2/1998 | Paul | F02B 63/06 62/505 |
| 6,571,576 | B1 | 6/2003 | Lifson et al. | |
| 7,992,408 | B2 | 8/2011 | Bush et al. | |
| 8,079,229 | B2 | 12/2011 | Lifson et al. | |
| 8,418,482 | B2 | 4/2013 | Bush et al. | |
| 8,769,982 | B2 | 7/2014 | Ignatiev et al. | |
| 9,938,967 | B2 | 4/2018 | Ignatiev et al. | |
| 10,145,587 | B2 | 12/2018 | Ascani | |
| 10,253,766 | B2 | 4/2019 | Lifson et al. | |
| 10,352,308 | B2 | 7/2019 | Bergman et al. | |
| 2008/0080995 | A1 | 4/2008 | Inoue | |
| 2008/0148764 | A1 | 6/2008 | Cao | |
| 2008/0256961 | A1 | 10/2008 | Lifson et al. | |
| 2010/0068085 | A1 | 3/2010 | Terauchi | |
| 2014/0202187 | A1 | 7/2014 | Cur et al. | |
| 2014/0377081 | A1 * | 12/2014 | Bagagli | F04B 49/03 417/288 |
| 2018/0180041 | A1 | 6/2018 | Pereira | |
| 2018/0258922 | A1 | 9/2018 | Ascani | |

FOREIGN PATENT DOCUMENTS

| | | | |
|---|---|---|---|
| GB | 260984 | A | 1/1928 |
| WO | 9918353 | A1 | 4/1999 |
| WO | 2016182998 | A1 | 11/2016 |
| WO | 2020084545 | A1 | 4/2020 |

OTHER PUBLICATIONS

European Office Action for application EP 22188169.1, Issued Nov. 15, 2024 in U303283EP, 18 pages.

* cited by examiner

ECONOMIZER INJECTION IN A RECIPROCATING COMPRESSOR

CROSS-REFERENCE TO RELATED APPLICATIONS

This application claims the benefit of U.S. Provisional Application No. 63/229,250 filed Aug. 4, 2021, the disclosure of which is incorporated herein by reference in its entirety.

BACKGROUND

Exemplary embodiments of the present disclosure relate to the art of compressors, and more particularly, to a system and method for compressing a flow from an economizer within a compressor.

Typically, a multi-stage compressor is used in a vapor compression system including an economizer. A multi-stage compressor includes a first compressor stage and a separate second compressor stage arranged in fluid communication with an outlet of the first compressor stage. In operation, refrigerant compressed within the first compressor stage is discharged from an outlet of the first compressor stage and is delivered to an inlet of the second compressor stage. When used with an economizer, the refrigerant gas from the economizer is typically injected into the conduit connecting the two compressor stages. Accordingly, the refrigerant output from the first compressor stage and the refrigerant from the economizer are compressed together within the second compressor stage. Each compressor stage adds size, complexity, and cost to the compressor.

BRIEF DESCRIPTION

According to an embodiment, a compressor includes a cylinder block having a first bore and a cylinder head overlapping the cylinder block. The cylinder head has a second bore aligned with the first bore. The second bore is separated into a plurality of distinct regions including a suction region and an economizer region. A plurality of valves includes a suction valve selectively operable to fluidly couple the suction region and the first bore, and an economizer valve selectively operable to fluidly couple the economizer region and the first bore.

In addition to one or more of the features described above, or as an alternative to any of the foregoing embodiments the suction region is configured to receive a first flow of refrigerant having a first pressure and the economizer region is configured to receive a second flow of refrigerant having a second pressure, the second pressure being greater than the first pressure.

In addition to one or more of the features described above, or as an alternative to any of the foregoing embodiments the plurality of regions further comprises a discharge region and the plurality of valves further comprises a discharge valve selectively operable to fluidly couple the discharge region and the first bore.

In addition to one or more of the features described above, or as an alternative to any of the foregoing embodiments at least one of the suction valve and the discharge valve is a check valve.

In addition to one or more of the features described above, or as an alternative to any of the foregoing embodiments the economizer valve is solenoid valve.

In addition to one or more of the features described above, or as an alternative to any of the foregoing embodiments comprising a sensor operable to monitor a pressure within the first bore.

In addition to one or more of the features described above, or as an alternative to any of the foregoing embodiments the plurality of regions further comprises a fourth region, the sensor being located within the fourth region.

In addition to one or more of the features described above, or as an alternative to any of the foregoing embodiments comprising a controller operably coupled to the sensor and to the economizer valve, wherein the controller is configured to operate the economizer valve in response to information provided by the sensor.

According to an embodiment, a method of operating a reciprocating compressor includes drawing a first flow of refrigerant into a cylinder of the reciprocating compressor via a suction valve, moving a piston within the cylinder to increase a pressure within the cylinder, drawing a second flow of refrigerant into the cylinder of the reciprocating compressor via an economizer valve, moving the piston to further increase the pressure within the cylinder, and discharging a mixture of the first flow of refrigerant and the second flow of refrigerant from the cylinder via a discharge valve.

In addition to one or more of the features described above, or as an alternative to any of the foregoing embodiments the economizer valve and the discharge valve are closed during the drawing the first flow of refrigerant into the cylinder.

In addition to one or more of the features described above, or as an alternative to any of the foregoing embodiments the suction valve and the discharge valve are closed during the drawing the second flow of refrigerant into the cylinder.

In addition to one or more of the features described above, or as an alternative to any of the foregoing embodiments comprising determining when the piston is at a desired position within a cycle of movement, the desired position being associated with operation of the economizer valve.

In addition to one or more of the features described above, or as an alternative to any of the foregoing embodiments determining when the piston is at the desired position within the cycle of movement further comprises: determining if the pressure within the cylinder is equal to or greater than a predetermined threshold of an economizer pressure and determining a direction of movement of the piston within the cylinder.

In addition to one or more of the features described above, or as an alternative to any of the foregoing embodiments determining the direction of movement of the piston within the cylinder further comprises determining a rate of change of the pressure within the cylinder.

According to an embodiment, a method of operating an economizer valve associated with a cylinder of a reciprocating compressor includes measuring a pressure within the cylinder, determining if the pressure within the cylinder is equal to or greater than a predetermined threshold of an economizer pressure, and determining a direction of movement of a piston within the cylinder in response to determining that the pressure within the equal to or greater than the predetermined threshold of the economizer pressure.

In addition to one or more of the features described above, or as an alternative to any of the foregoing embodiments comprising opening the economizer valve when the direction of movement of the piston is upwardly.

In addition to one or more of the features described above, or as an alternative to any of the foregoing embodiments determining the direction of movement of the piston within the cylinder further comprises determining a rate of change of the pressure within the cylinder.

In addition to one or more of the features described above, or as an alternative to any of the foregoing embodiments the direction of movement of the piston is upwardly when the rate of change of the pressure within the cylinder is positive.

In addition to one or more of the features described above, or as an alternative to any of the foregoing embodiments determining if the pressure within the cylinder is equal to or greater than the predetermined threshold of the economizer pressure further comprises measuring the economizer pressure and comparing the pressure within the cylinder with the economizer pressure.

In addition to one or more of the features described above, or as an alternative to any of the foregoing embodiments comprising maintaining the economizer valve in a closed position if the pressure within the cylinder is less than the predetermined threshold of the economizer pressure.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
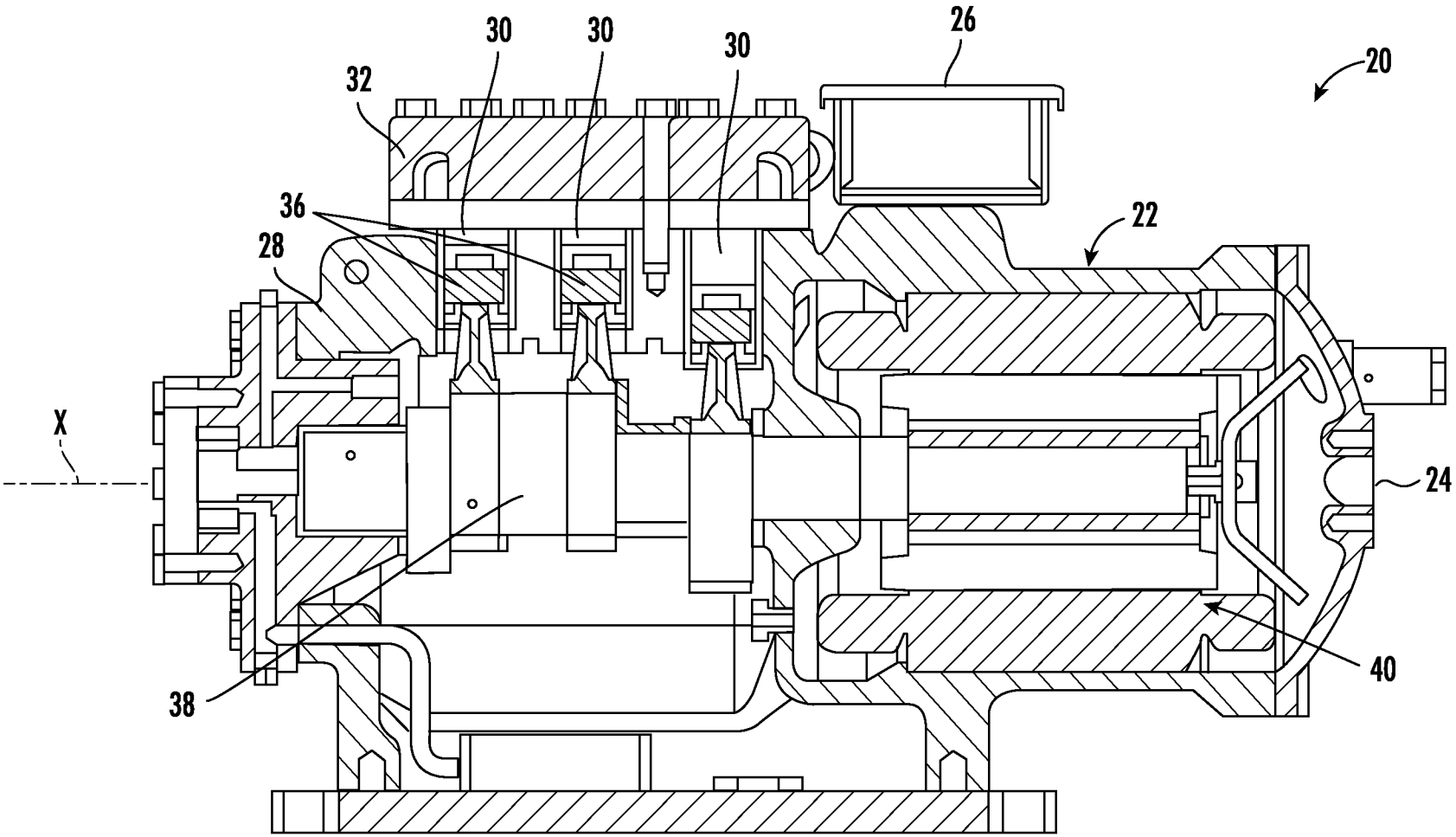
FIG. 1 is a schematic diagram of an example of a reciprocating compressor.
Figure 2:
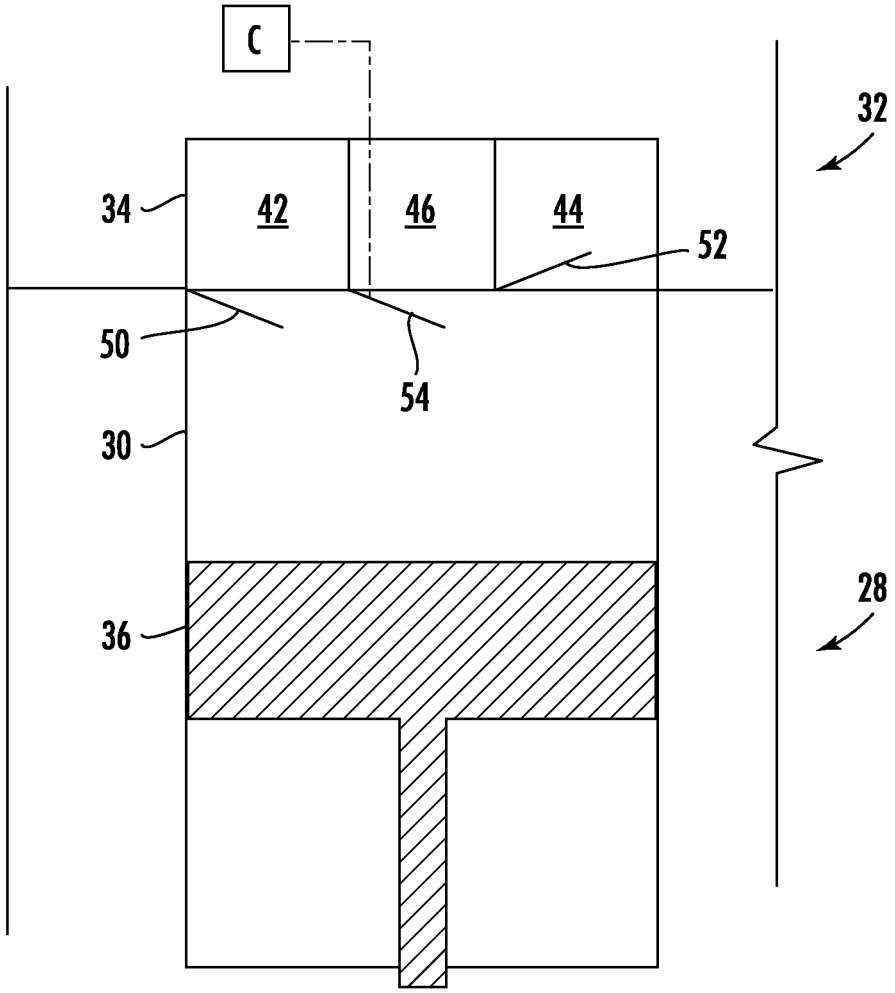
FIG. 2 is a schematic diagram of an exemplary portion of a reciprocating compressor according to an embodiment.

With reference now to FIG. 1, an example of a compressor 20, more specifically a reciprocating compressor, is illustrated. As shown, the compressor 20 has a housing 22 including a suction port or inlet 24 and a discharge port or outlet 26. The housing 22 includes a cylinder block 28 having one or more bores 30 formed therein, each of which defines a "cylinder" of the compressor 20. In an embodiment, a cylinder head 32 overlies a portion of the cylinder block 28. As best shown in FIG. 2, the cylinder head 32 includes one or more bores 34 corresponding to and aligned with the one or more bores 30 formed in the cylinder block 28.

Each cylinder 30 is configured to accommodate a piston 36 mounted for reciprocal movement at least partially within a cylinder 30. Examples of multi-cylinder configurations include, but are not limited to, in-line, V, and horizontally opposed. In the illustrated, non-limiting embodiment, the compressor 20 includes three cylinders 30. However, it should be understood that a compressor 20 having a single cylinder, two cylinders, or more than three cylinders are also contemplated herein.

The one or more pistons 36 are coupled to a crankshaft 38 mounted within the housing 22. A motor 40 operably coupled to the crankshaft 38 is configured to rotate the crankshaft 38 about an axis of rotation X. Rotation of the crankshaft 38 causes each piston 36 to reciprocate within a respective cylinder 30 within the interior of the cylinder block 28.

As a piston 36 moves downwardly within a respective cylinder 30, a low pressure fluid, such as refrigerant gas for example, is drawn into the cylinder 30. After reaching a bottom of the cylinder 30, or the bottom of the cycle of movement of the piston 36, the piston 36 begins to move upwardly within the cylinder 30. As the piston 36 moves upwardly, the low pressure refrigerant gas within the cylinder 30 is compressed causing the pressure to build within the cylinder 30. This increase in pressure in combination with the movement of the piston 36 causes the high pressure refrigerant gas to flow from the cylinder 30.

An existing compressor 20 configured for use with a vapor compression system including an economizer or economizing heat exchanger typically includes a first compressor stage having at least one first piston and a second compressor stage having at least one second piston. The flow from the economizer is provided via an economizer inlet to an intermediate region of the compressor 20 arranged between the outlet of the first compressor stage and the inlet of the second compressor stage. As a result, the flow provided from the economizer bypasses the first compression stage and is therefore only compressed within the second compressor stage.

Figure 3:
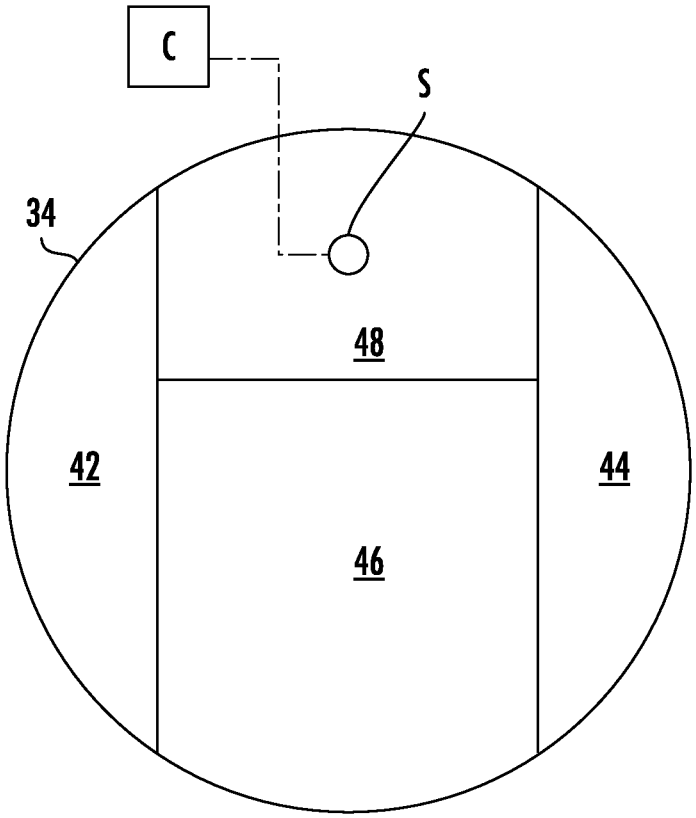
FIG. 3 is a plan view of an exemplary bore formed in a cylinder head of a reciprocating compressor according to an embodiment.

With reference now to FIGS. 2-3, a portion of a reciprocating compressor for use in a vapor compression system having an economizer is illustrated in more detail. As shown, a bore 34 formed in the cylinder head 32 may be divided into a plurality of fluidly distinct regions. The regions include a suction region 42 and a discharge region 44 which are common to pistons of an existing reciprocating compressor. However, in the illustrated, non-limiting embodiment, best shown in FIG. 3, the plurality of regions of the bore 34 additionally includes an economizer region 46. As shown, the economizer region 46 may be positioned centrally between the suction and discharge regions 42, 44. However, embodiments where the economizer region 46 is arranged at the same side of both the suction and discharge regions 42, 44 are also contemplated herein.

A plurality of valves are disposed at the interface between the bore 34 of the cylinder head 32 and a corresponding, aligned bore 30 within the cylinder block 28. In addition to a suction valve 50 associated with the suction region 42 and a discharge valve 52 associated with the discharge region 44, the compressor 20 may further include an economizer valve 54 associated with the economizer region 46. In an embodiment, the suction valve 50 and the discharge valve 52 are check valves or no-back valves. The economizer valve 54 may also be a check valve, or alternatively, may be a valve actuated (electrically, pneumatically, hydraulically, etc. . . . ) in response to a signal or command generated by a controller, illustrated schematically at C, such as a solenoid valve for example. However, it should be understood that any suitable type of valve may be used for each of the valves disclosed herein. Accordingly, in an embodiment, one or both of the suction and discharge valves 50, 52 may be actuated in response to a command from the controller C rather than automatically in response to a pressure or flow rate of the refrigerant acting thereon for example.

The economizer valve 54 associated with the economizer region 46 of the bore 34 is selectively operable to provide a flow to the cylinder 30 when the piston 36 is at a desired position of its cycle of movement. In an embodiment, the economizer valve 54 is operable to deliver the flow from the economizer in response to the absolute cylinder pressure and/or the rate of pressure rise within the cylinder 30.

To monitor the motion of the piston 36 within the cylinder 30, the reciprocating compressor 20 may include a sensor S (see FIG. 3) operable to detect a pressure within a cylinder 30 of the cylinder block 28. The sensor S, such as a pressure transducer for example, may be mounted within the bore 30. In an embodiment, the plurality of regions formed in the bore 34 of the cylinder head 32 includes a fourth region 48 that is open to and in fluid communication with the adjacent cylinder 30 of the cylinder block 28. The fourth region 48 may be disposed between the suction and discharge regions 42, 44 as shown, or may be located at another area. In such embodiments, the sensor S may be mounted within the fourth region 48 of the bore 34 in the cylinder head 32 such that the sensor S is fluidly coupled to the cylinder 30. However, it should be understood that any suitable type of sensor used to ultimately determine a pressure within the bore and a sensor arranged at any suitable location is within the scope of the disclosure.

Figure 4:
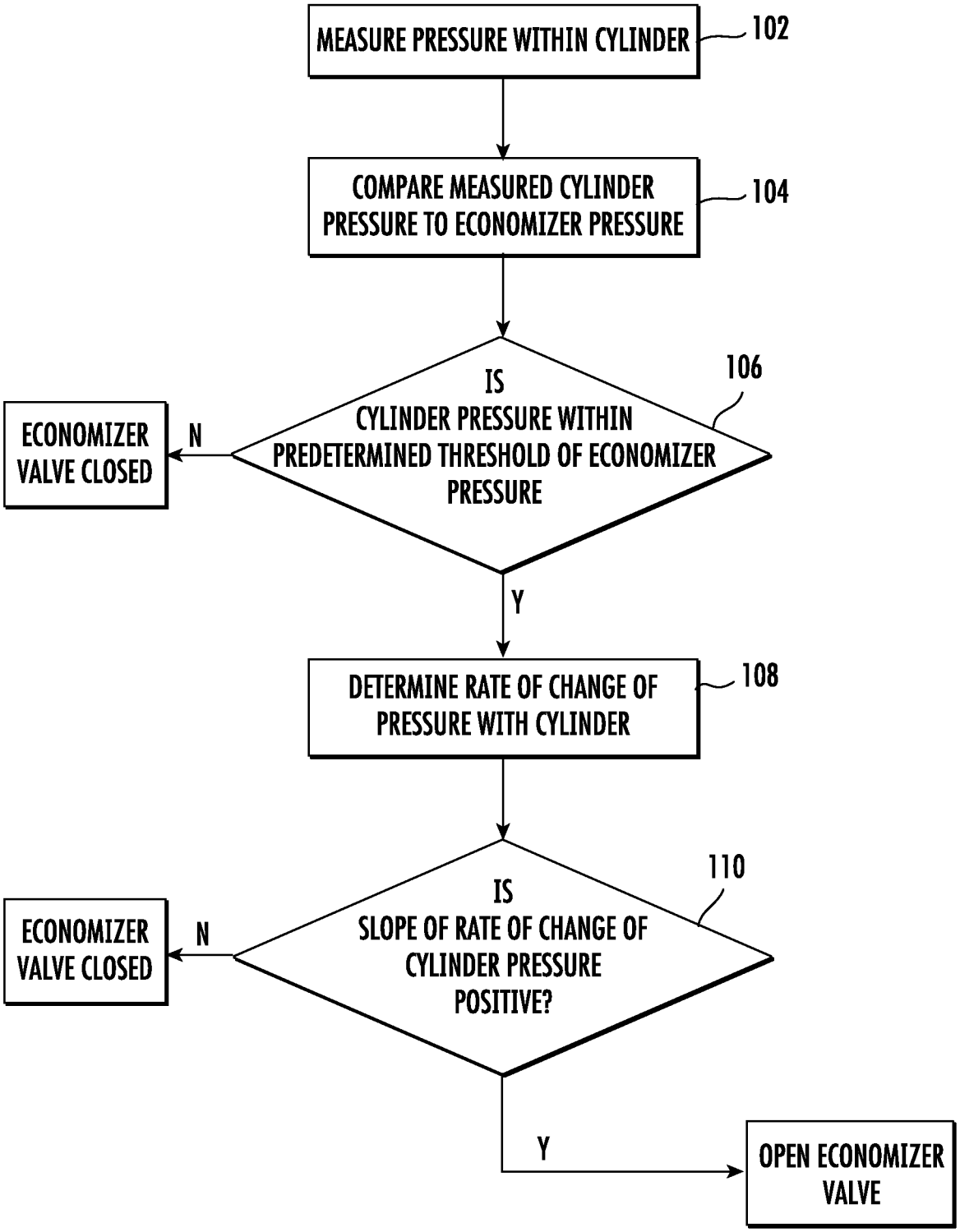
FIG. 4 is a flow diagram illustrating a method for evaluating when to open an economizer valve associated with an economizer region of a bore formed in a cylinder head according to an embodiment.

The pressure within the cylinder 30 may be monitored continuously or at intervals. With reference now to FIG. 4, in an embodiment, the pressure within the cylinder 30 that is sensed or calculated using data collected by the sensor S (block 102), is compared with a pressure of the economizer, as shown in block 104. The pressure of the economizer may be measured via another sensor, such as at or directly adjacent to an outlet of the economizer. Alternatively, the pressure of the economizer may be measured at any position within a conduit extending between and fluidly coupling the outlet of the economizer and an economizer inlet of the compressor 20. The piston 36 is at the desired location of its cycle of movement within the cylinder 30 for receiving the flow from the economizer when the pressure within the cylinder 30 is at a predetermined threshold relative to the pressure of the economizer. In an embodiment, the piston 36 is at the desired position of its cycle of movement within the cylinder 30 for receiving the flow from the economizer when the pressure within the cylinder 30 is equal to or greater than about 95% of the pressure of the economizer. However, embodiments where the predetermined threshold is different, such as where the predetermined threshold is equal to or greater than about 90% for example, are also contemplated herein. If the cylinder pressure is not within the predetermined threshold of the economizer pressure as shown in block 106, the economizer valve 54 remains closed.

Because the piston 36 is at the same location within the cylinder 30 twice during every cycle (once as the piston 36 moves up and once as the piston 36 moves down, the direction of movement of the piston 36 is critical to determining when the piston is at the desired position of its cycle of movement within the cylinder 30 for receiving the economizer flow. Accordingly, in an embodiment, in addition to determining if the cylinder pressure is equal to or greater than the predetermined threshold of the economizer pressure, the sensor data may further be used to calculate a rate of change of the pressure within the cylinder 30 (see block 108). The rate of change may be used to indicate a direction of movement of the piston 36. For example, a positive rate of change may indicate that the piston 36 is moving vertically upwardly and a negative rate of change may indicate that the piston is moving vertically downwardly. Accordingly, a slope of the rate of change is then evaluated in block 110 to determine the direction of movement of the piston. The rate of change in combination with the absolute pressure may therefore be used to ensure that the flow from the economizer is provided to the cylinder 30 when the piston 36 is moving in a compression direction.

During the suction cycle, as the piston 36 moves vertically downwardly within the cylinder 30, the suction valve 50 opens, thereby allowing a first flow of refrigerant gas having a first pressure to be drawn into the cylinder 30. This operation of the suction valve 50 may be caused by the pressure resulting from movement of the cylinder 30. During this downward movement, the economizer valve 54 and the discharge valve 52 remain in a closed position.

Once the piston 36 reaches the bottom of the as the piston 36 moves vertically downward and begins to move upwardly, the refrigerant is compressed. The suction valve 50 closes in response to a biasing force of the suction valve 50 and/or the increasing pressure within the cylinder 30. As the piston 36 continues to move upwardly, the pressure within the cylinder 30 continues to build. Once the pressure within the cylinder 30 satisfies the conditions associated with operation of the economizer valve 54, for example, when the rate of change of the pressure is positive and the pressure within the cylinder 30 is equal to or greater than the pressure of the economizer, the controller C will generate a command causing the economizer valve 54 to be opened. With the economizer valve 54 open, a second flow of refrigerant having a second pressure, for example greater than the first pressure, is provided to the cylinder 30. Within the cylinder 30, the second flow of refrigerant and the first flow of refrigerant mix.

When the economizer valve 54 is open, both the suction valve 50 and the discharge valve 52 are closed. Further, when the economizer valve 54 is open, the piston 36 has not yet reached the peak of its path of motion. As a result, compression occurs via further movement of the piston 36 once the second flow of refrigerant from the economizer is provided to the cylinder 30. Once the pressure within the cylinder 30 exceeds a pressure associated with the discharge valve 52, the discharge valve 52 will be forced open, allowing the compressed refrigerant to flow from the cylinder 30 therethrough. As the piston 36 begins to move downwardly and the pressure reduces, the biasing force of the discharge valve 52 will bias the discharge valve 52 closed, and the cycle will repeat itself.

Although a bore 34 having an economizer region 46 illustrated and described herein, it should be understood that a compressor 20 having any number of such bores 34 is within the scope of the disclosure. Further, in embodiments where the vapor compression system includes a plurality of economizers, one or more bores 34 formed in the cylinder head 32 and having an economizer region as described herein may be associated with a respective one of each of the plurality of economizers. By including a cylinder head 32 having a bore 34 with an economizer region 46 formed therein, the need for a compressor 20 having two separate compression stages can be eliminated. As a result, the foot print, complexity, and associated cost of the compressor 20 can be reduced.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A compressor comprising:

a cylinder block having a first bore;

a cylinder head overlapping the cylinder block, the cylinder head having a second bore aligned with the first bore, wherein the second bore is separated into a plurality of regions including a suction region and an economizer region, the economizer region being distinct from the suction region;

a plurality of valves including a suction valve selectively operable to fluidly couple the suction region and the first bore, and an economizer valve selectively operable to fluidly couple the economizer region and the first bore;

a sensor operable to monitor a pressure within the first bore, wherein the economizer valve is operable based on a rate of change of a pressure within the first bore measured and;

a controller operably coupled to the sensor and to the economizer valve, wherein the controller is configured to operate the economizer valve in response to the rate of change of the pressure sensed within the first bore.

2. The compressor of claim 1, wherein the suction region is configured to receive a first flow of refrigerant having a first pressure and the economizer region is configured to receive a second flow of refrigerant having a second pressure, the second pressure being greater than the first pressure.

3. The compressor of claim 1, wherein the plurality of regions further comprises a discharge region and the plurality of valves further comprises a discharge valve selectively operable to fluidly couple the discharge region and the first bore.

4. The compressor of claim 3, wherein at least one of the suction valve and the discharge valve is a check valve.

5. The compressor of claim 1, wherein the economizer valve is a solenoid valve.

6. The compressor of claim 1, wherein the plurality of regions further comprises a fourth region, the sensor being located within the fourth region.

* * * * *